US005333567A

United States Patent [19]

Danzer

[11] Patent Number: 5,333,567

[45] Date of Patent: Aug. 2, 1994

[54] JIBE CONTROLLER

[76] Inventor: Gustave J. Danzer, 2308 San Antonio Ave., Alameda, Calif. 94501

[21] Appl. No.: 69,624

[22] Filed: Jun. 1, 1993

[51] Int. Cl.[5] ..... B63H 9/04

[52] U.S. Cl. ..... 114/102; 114/39.1; 114/98

[58] Field of Search ..... 114/98, 99, 102, 103, 114/39.1; 188/297, 301, 302, 312, 322.15

[56] References Cited

U.S. PATENT DOCUMENTS 4,138,962 2/1979 Waelder ..... 114/102
4,630,564 12/1986 Duckman et al. ..... 114/98
4,635,908 1/1987 Ludwig ..... 188/322.15
4,704,979 11/1987 Ammen et al. ..... 114/98

*Primary Examiner*—Jesus D. Sotelo

[57] ABSTRACT

A device which limits the violent motion of a sailboat boom during jibing, comprising a passive resistance means which responds to violent or rapid motion and which is connected between the boom and some fixed point on the vessel, and which may be provided with a control valve to render it inoperative during gentle maneuvers.

5 Claims, 3 Drawing Sheets

JIBE CONTROLLER

BACKGROUND—FIELD OF INVENTION

This invention relates to controlling the boom of a sailing vessel, and particularly to controlling and eliminating the danger from the boom while jibing.

BACKGROUND—DESCRIPTION OF PRIOR ART

Jibing is the act of turning a sailing vessel which is sailing with the apparent wind source behind an imaginary line at right angles to the hull, such that the wind, at the end of the maneuver, comes from the other rear quarter. The boom of a vessel will always tend to be over the side of the vessel away from the wind, and the cross over, in the middle of the jibe, is usually very sudden and violent. The problems inherent in jibing are well known to the sailor. The intentional jibe normally requires that one person devote him/herself exclusively to controlling each boom. One way of dealing with the problem, when there is insufficient crew, is to "come about" through 270 degrees in the opposite direction of the jibe. This solution is not popular in narrow channels or closely run races. The unintentional jibe presents a more pressing problem. A sudden change in wind direction of only a few degrees can create a jibe situation for even the most prudent helmsperson, and the results can be devastating, even including dismasting of the vessel and loss of life of any crew member struck by the boom as it swings violently to the leeward side of the vessel. One way of dealing with this is to rig a "preventer", which is a line attached to the boom and run forward to some sufficiently sturdy location on the vessel where it is made fast. The great limitation of such a preventer is that while it prevents the boom from jibing, it leaves one with the main sail backwinded, a possibly uncontrollable vessel, and yet another crisis situation.

Wadder, in U.S. Pat. No. 4,138,962, addresses this problem with a system of lines running athwart ship from gunwale to gunwale and passing through a system of sheaves and braking devices mounted to the boom. These lines, running as they do across accustomed pathways, constitute a nuisance if not a hazard in their own right. Further, his device involves a large spool (which is unsightly) hanging from the boom, and the device, while serving as a sort of partial boom vang, would seem to make use of a fully functional boom vang impossible without compromising the benefits of his device.

Duckman and Duckman in patent U.S. Pat. No. 4,630,564 show a different arrangement in which a device acting as a spring, "urges" the boom of a sailboat into a substantially transverse position. However, this design would perforce result in back-winding of the mainsail under many conditions, and while it would reduce the force of the first half of a jibe, it would increase the force of the second half, the net benefit being nearly nil.

OBJECTS AND ADVANTAGES

What would be desirable would be a device which controlled the boom in a jibe situation, did not hamper boom movement in other situations, did not provide potentially hazardous obstructions across accustomed pathways, was not unsightly and did not preclude the use of other rigging devices such as vangs.

Readers will find further objects and advantages of the invention from consideration of the ensuing description and the accompanying drawings.

DRAWING FIGURES

Drawing Reference Numerals

Figure 1:
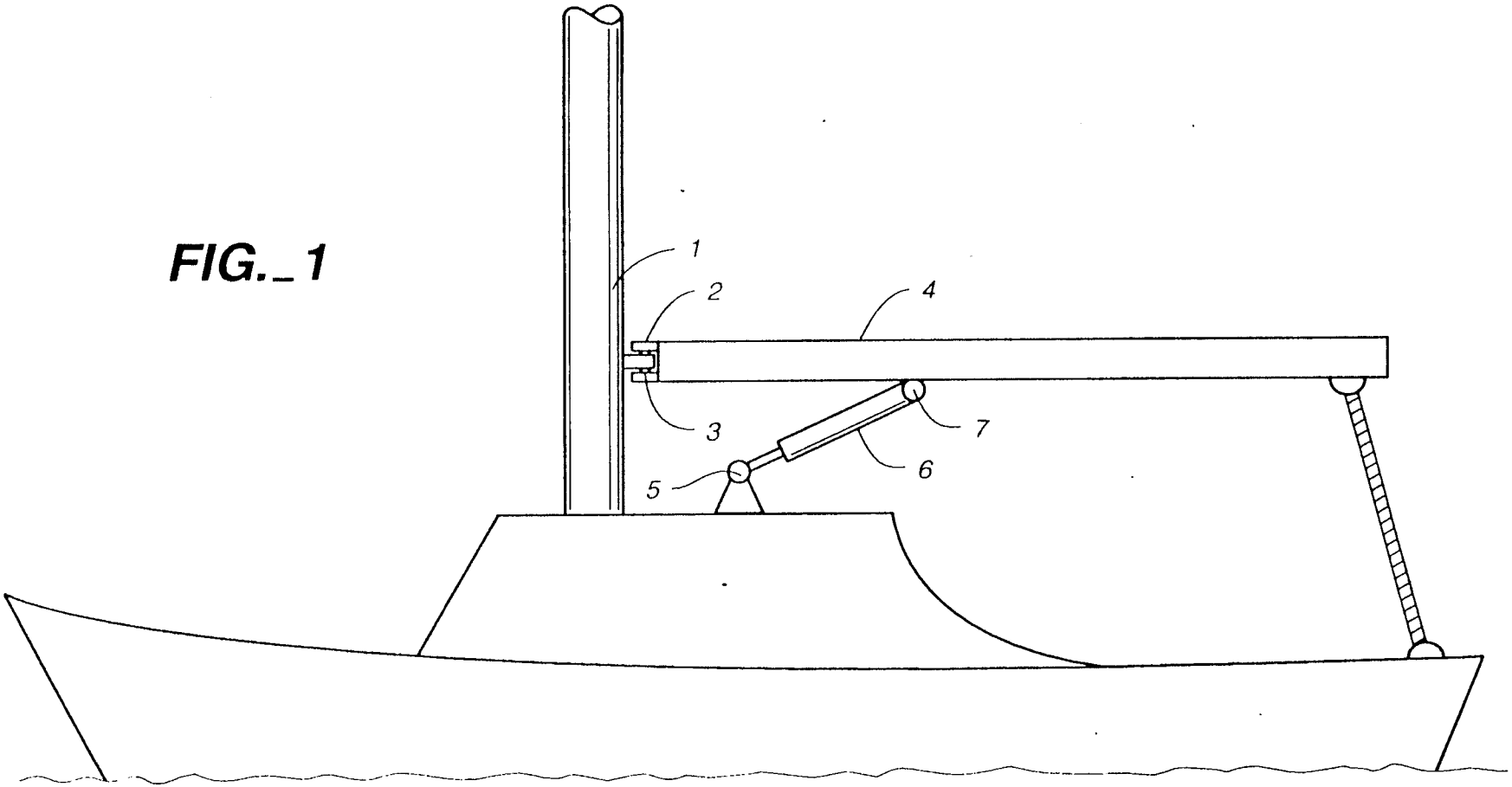
FIG. 1 shows a profile view of a preferred embodiment of the invention fitted to a sailboat.

1. Mast
2. "Goose Neck" fitting
3. Pivot point of "goose neck"
4. Boom
5. Forward attachment joint
6. Linear passive resistance means
7. Aft attachment joint
8. Movable member, resistance means
9. Stationary member, resistance means
10. Relief orifice
11. Main orifice
12. Pith ball
13. Main sheet
14. Control valve body
15. Connecting link
16. Forward link connecting joint
17. Aft link connecting joint

JIBE CONTROLLER—DESCRIPTION

Figure 3:
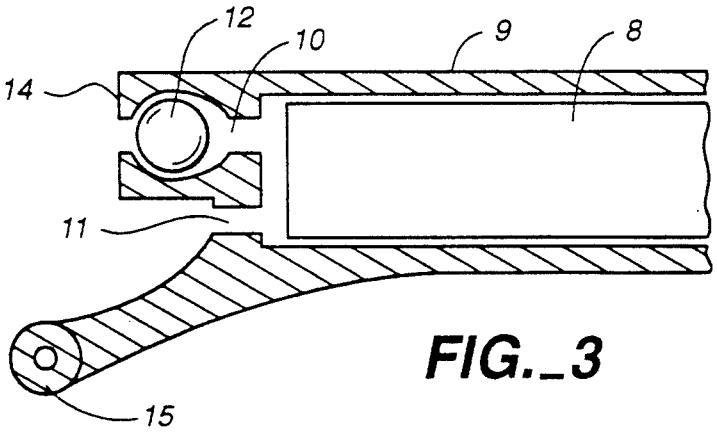
FIG. 3 shows a sectional profile of a possible non-adjustable control valve in a pneumatic embodiment of the invention.

The preferred embodiment as shown in FIG. 1 of the invention comprises a linear passive resistance means 6 attached at its forward end to some point along the centerline of a vessel, aft of the mast 4, by a joint 5, said joint allowing angular movement around the vertical and transverse axes of the vessel, and said linear resistance means 6 being attached at its after end to some point on the boom 4 by a similar joint 7. FIG. 3 shows a control valve with which said linear resistance means is provided, such that said linear resistance means provides significant resistance only in response to sudden, rapid motion.

Figure 4:
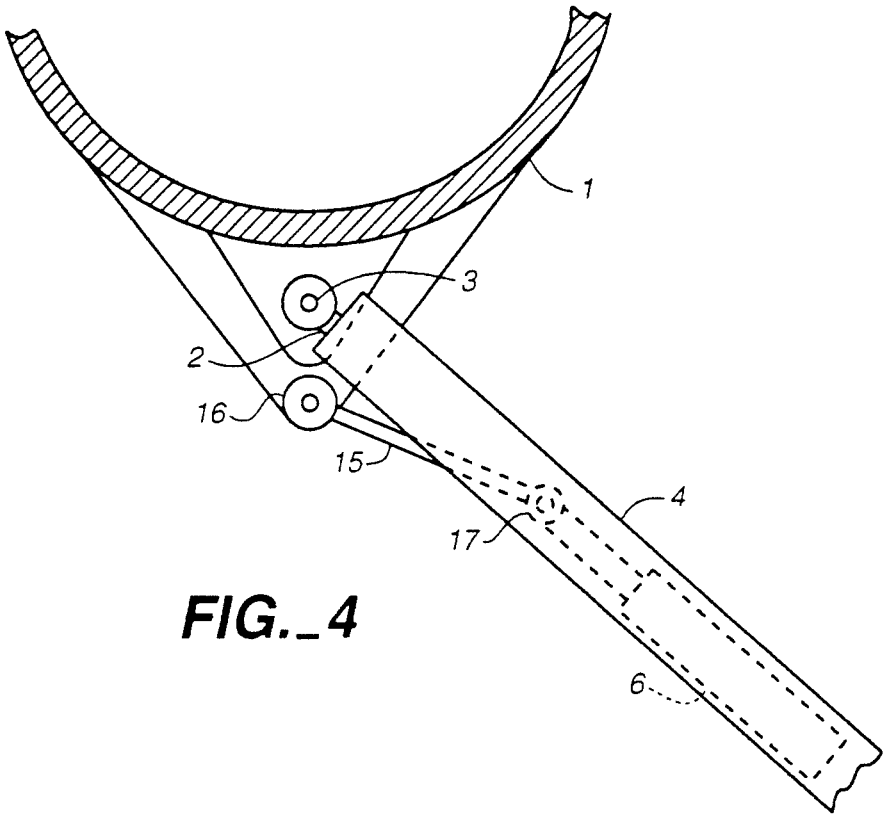
FIG. 4 shows a sectional view from above of an embodiment wherein the resistance means is rigidly attached to the boom.
Figure 5:
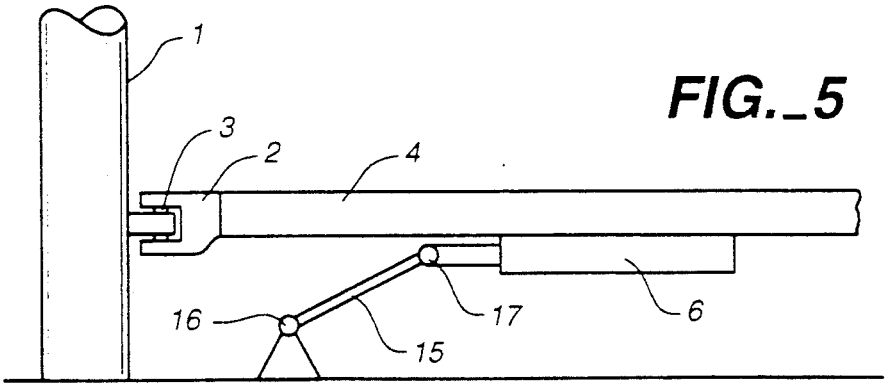
FIG. 5 shows a sectional side view of the above-mentioned embodiment.

Another embodiment shown in FIGS. 4 and 5 comprises a similar linear resistance means 6 attached rigidly to the boom 4 and at its forward end having a joint 17 similar to previously described attachment joints 5,7 connecting it to a link 15 which is in turn connected to a fixed mount on the vessel by means of another similar attachment joint 16.

PNEUMATIC-LINEAR-EXTERNAL JIBE CONTROLLER—OPERATION

Figure 2:
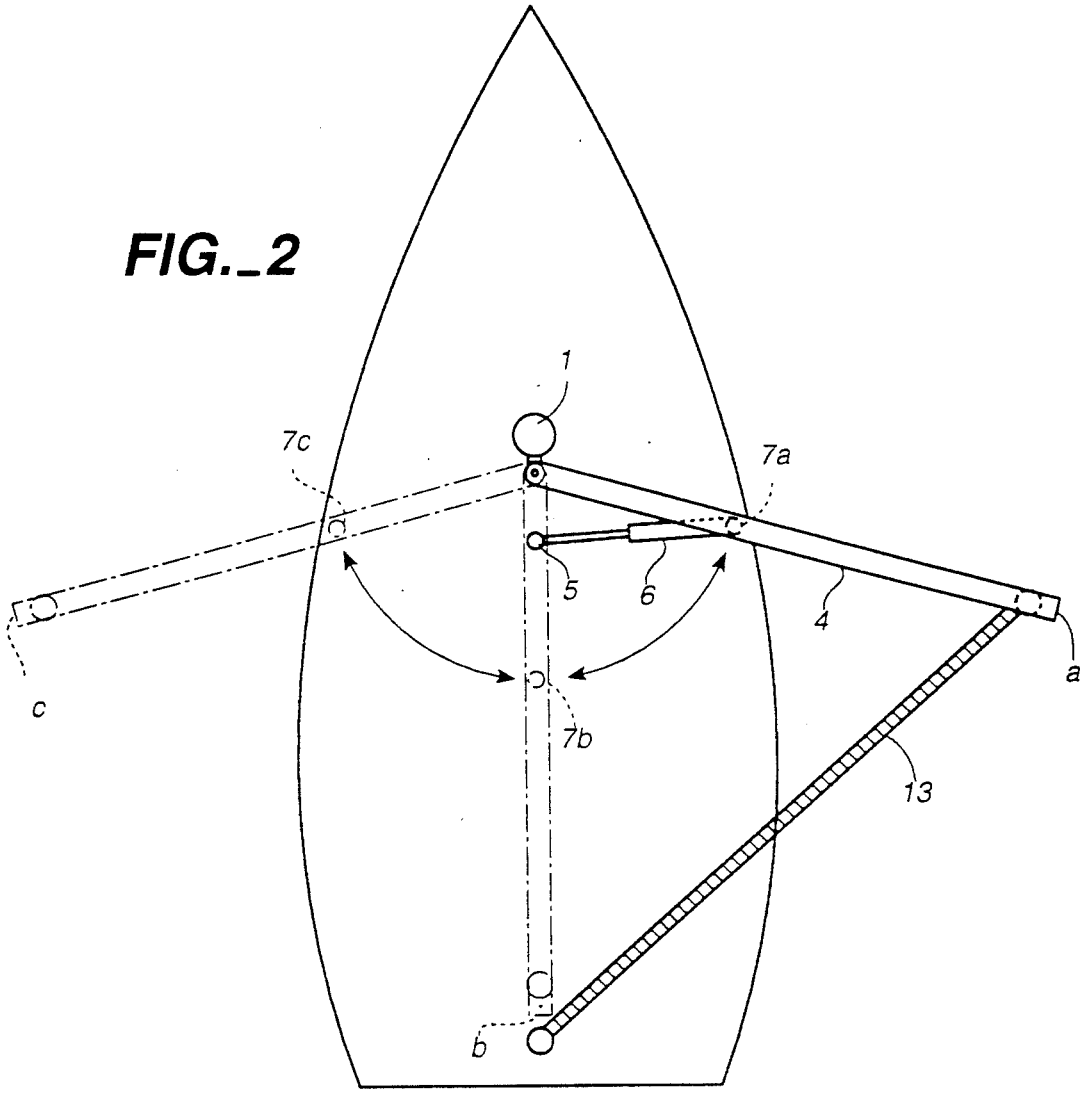
FIG. 2 shows the articulation of the said preferred embodiment of the invention during a jibe.

When a boat is "running" before the wind, the boom is allowed to approach an angle of 90 degrees to the centerline of the vessel as shown in FIG. 2, position a. It is restrained by a rope commonly referred to as a "sheet" 13. When jibing, the boom swings from its position on one side of the vessel to a similar position of the opposite side.

Referring to FIG. 2 and FIG. 3, a jibe will cause the boom 4 to carry the aft attachment joint 7 of the jibe controlling device through an arc including points *7a,7b,7c*. The length of the resistance means 6 which is comprised of a movable member 8, a stationary member 9, and a control valve assembly 10–14, is the distance from the forward attachment joint 5 to the aft attachment joint 7. As simple geometry reveals that the distance from the forward attachment joint 5 to the after attachment joint 7 is the same at positions "a" and "c" but significantly less at position "b" then it can be seen that during the course of a jibe the following occurs: the boom 4 begins rapid angular movement around its pivot point 3, causing sudden shortening of the resistance means 6 by forcing movable member 8, which is effectively a piston, into the stationary member 9, which is a closely fitting cylinder. This causes the pith ball 12 to block the forward end of the control valve 14, limiting the flow of escaping air to the smaller main orifice 11 which results in a great resistance to continued rapid shortening of the resistance means 6. As the boom 4 approaches the centerline of the vessel (FIG. 3, position "b") the rate of shortening of the resistance means 6 approaches zero, the pith ball 12 is allowed to drop back into the main cavity of the control valve body 14, and the relief orifice 10, being reopened, reduces resistance to further shortening of the resistance means to a negligible point. As the boom 4 continues in its arc, its rapid acceleration causes an extension of the linear resistance means 6 which creates a negative pressure in the cylinder causing the pith ball 12 to be sucked into and block the aft end of the control valve 14. Air flow is again limited to the main orifice 11, and resistance to continued rapid extension increases to a very great degree and is maintained until angular motion of the boom 4 is stopped as it reaches the limits of the "sheet" 13.

SUMMARY, RAMIFICATIONS AND SCOPE

Thus it can be seen that the jibe control device of this invention, while completely compatible with other optional rigging such as boom vangs and without necessitating any undesirable and potentially dangerous obstructions across decks, completely controls the potentially fatally dangerous swinging of the boom during a jibe. During "coming about" maneuvers, the gradual movement of the boom is such that the control valve 14 will be unaffected, and the boom will swing without noticeable added resistance, or opportunity for backwinding.

While my above description contains many specificities, these should not be construed as limitations on the scope of the invention but rather as an exemplification of one preferred embodiment thereof. Many variations are possible. For example, those skilled in the art will readily see that connecting joints other that those described can be employed. One skilled in the art would also see the possibility of eliminating the control valve and dimensioning the main orifice such that resistance is deemed sufficient during a jibe and acceptable during other maneuvers. They will also appreciate that as the linear passive resistance means is analogous to a tubular automotive shock absorber or door slamming preventer, a jibe controller analogous to a lever-type shock absorber or door slamming preventer is obvious. A person skilled in the art will also appreciate that the resistance means can be as easily hydraulic as pneumatic. One skilled in the art will also see that in the embodiment wherein the resistance means is affixed rigidly to the boom, it can easily be concealed within the boom, the linkage being accomplished through a slot. It would be further obvious that the control valve can have adjustable valving to adapt to varying conditions and that the valving can be mounted remotely from the passive resistance means, suggesting a resistance adjusting means mounted near the helm.

I claim:

1. In a sailing vessel having a mast and a swingable boom extending rearward from said mast and a sail supported between the mast and the boom, a device for controlling the boom during jibing, comprising: a passive resistance means for resisting the swing of the boom during the jibe, a connecting means between said passive resistance means and the boom of said vessel, and a connecting means between said passive resistance means and a fixed point on said vessel.

2. The device in claim 1 wherein the passive resistance means is a pneumatic cylinder.

3. The pneumatic cylinder of claim 2 wherein a control valve providing a resistance varying means is included.

4. The device of claim 1 wherein the passive resistance means is an hydraulic cylinder.

5. The hydraulic cylinder of claim 4 wherein a control valve providing a resistance varying means is included.

* * * * *